United States Patent [19]

Kim

[11] Patent Number: 4,669,803

[45] Date of Patent: Jun. 2, 1987

[54] ANTENNA FEEDER-CONNECTING TERMINAL FOR A TELEVISION

[75] Inventor: Eui D. Kim, Kumi, Rep. of Korea

[73] Assignee: Gold Star Co., Ltd., Seoul, Rep. of Korea

[21] Appl. No.: 868,572

[22] Filed: May 30, 1986

[30] Foreign Application Priority Data

May 31, 1985 [KR] Rep. of Korea ..... 6630/1985

[51] Int. Cl.[4] ..... H01R 13/73

[52] U.S. Cl. ..... 439/571; 439/868

[58] Field of Search ..... 339/14 R, 95 D, 125 R, 339/126 R, 223 R; 174/51, 84 C

[56] References Cited

U.S. PATENT DOCUMENTS

| | | | |
|---|---|---|---|
| 3,229,239 | 1/1966 | Modrey | 339/125 R |
| 3,459,396 | 8/1969 | Buttriss | 339/126 R X |
| 3,541,227 | 11/1970 | Bendrick | 174/84 C X |
| 4,526,428 | 7/1985 | Sachs | 339/14 R |

*Primary Examiner*—Z. R. Bilinsky

*Attorney, Agent, or Firm*—Birch, Stewart, Kolasch & Birch

[57] ABSTRACT

The present invention relates to an antenna feeder-connecting terminal for a television, and particularly to an antenna feeder-connecting terminal including a pair of holding members adapted to hold the antenna feeder therein.

2 Claims, 4 Drawing Figures

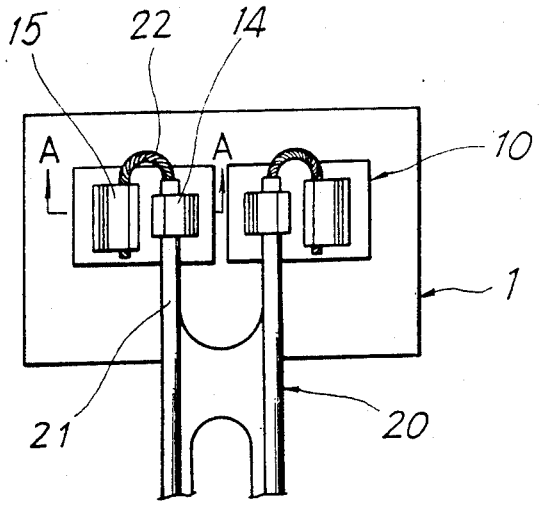
FIG, 2
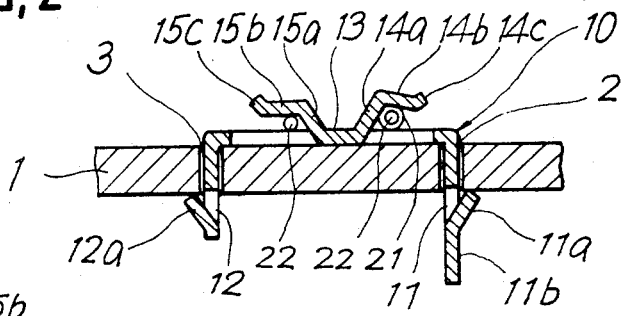
FIG, 3
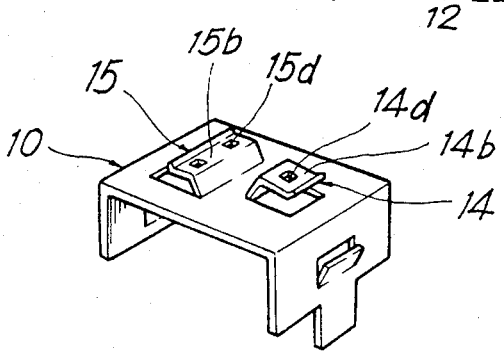
FIG, 4

ANTENNA FEEDER-CONNECTING TERMINAL FOR A TELEVISION

BACKGROUND OF THE INVENTION

The present invention relates to an antenna feeder-connecting terminal for a television, and particularly to an antenna feeder-connecting terminal including a pair of holding member adapted to hold the antenna feeder therein.

Where an antenna has to be equipped, for example, in a television, generally, each core wire of the feeder connected to the antenna is firmly connected to a terminal disposed on a terminal plate of a body of the television. It is desirable that such operation for holding each core wire of the antenna feeder be more simplified, assured, and stabilized. As a conventional one, there has been used an antenna feeder-connecting terminal comprising a terminal body curved to form a channel-shape and provided, at the upper wall thereof, with a threaded hole, and a clamping screw fitted in said threaded hole and adapted to firmly hold the core wire of antenna feeder in the terminal, said screw having, at the lower end thereof, a means for preventing any occasional separations of the screw from the threaded hole. In order to construct such type of conventional terminal, it is necessary to provide complicated and troublesome works for machining and assembling parts of the terminal, in that a threaded hole has to be formed on the upper wall of the terminal body, and then, a clamping screw has to be fitted into said threaded hole, and thereafter, a means for preventing any occasional separations of the screw from the threaded hole has to be formed. For holding an antenna feeder in the terminal, each core wire of the antenna feeder is wounded around the clamping screw, and then the screw is clamped, by means of such tool as a driver, to firmly hold the core wire in the terminal. In this case, the core wire contacted with the upper surface of the terminal is compressed and supported by only an annular head portion with a narrow radial width. As a result, the clamping of the screw may be loosened by a possible vibration and impact of the outside. When the antenna feeder by itself is pulled excessively, the core wire is easily loosened or separated from the terminal. In such conventional terminal, accordingly, it is impossible to provide a stable and assurable connection between the antenna feeder and the terminal.

SUMMARY OF THE INVENTION

Accordingly, an object of the present invention is to provide an antenna feeder-connecting terminal having a more simplified construction than the above-mentioned conventional one, so as to be more simply manufactured.

Other object of the present invention is to provide an antenna feeder-connecting terminal enabling the holding operation for the antenna feeder to be simplified and the connection of said feeder to the terminal to be assuredly and stably maintained.

In accordance with the present invention, these objects are accomplished by providing an antenna feeder-connecting terminal for a television, comprising a terminal body formed into a channel shape to have an upper wall and two side walls each having a means for fixing the terminal to a terminal plate mounted on the television, one of said side wall provided, at the lower end thereof, with a means for connecting the terminal to a terminal wire of the television, said terminal being characterized in that said terminal body includes a pair of holding members adapted to hold the clad wire and the core wire of said antenna feeder therein and formed on the upper wall of said terminal body by partially cutting said upper wall and curving the cut postions of said upper wall in opposite directions, each holding members having a resilient holding portion spaced from the upper surface of said upper wall of terminal body to form a wire-holding space with a slightly narrower width than the diameter of the corresponding wire and having a guiding portion adapted to guide the corresponding wire into said wire-holding space.

In accordance with the present invention, said resilient holding portion of each holding member may include one or more protrusions downwardly extended from the lower surface of said holding member. These protrusions function to more firmly hold the wires in the wire-holding spaces of the holding members, respectively.

The present invention can be more fully understood from the following detailed description when taken in conjunction with the accompanying drawings.

BRIEF DESCRIPTION OF THE DRAWINGS

FIG. 2 is a plan view of the terminal in accordance with th present invention, showing the condition of holding a feeder and its core wire in the terminal;

FIG. 3 is a cross-sectional view taken along lines A—A of FIG. 2; and

FIG. 4 is a perspective view of a terminal in accordance with another embodiment of the present invention.

DETAILED DESCRIPTION OF THE PREFERRED EMBODIMENT

Figure 1:
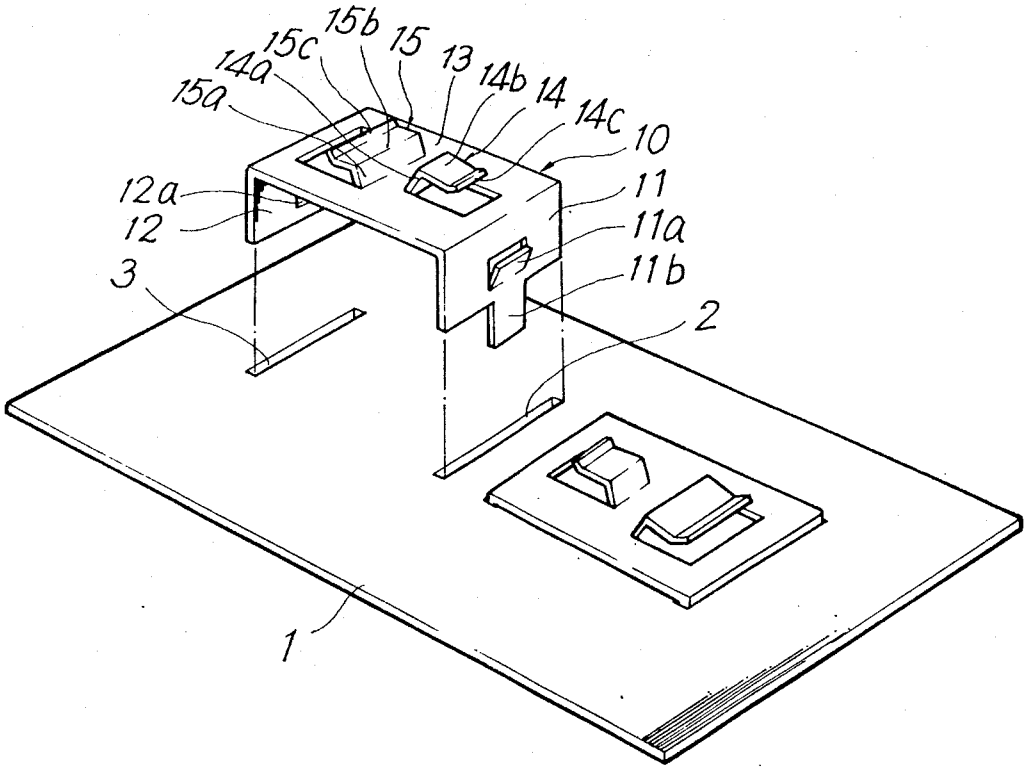
FIG. 1 is a partially exploded perspective view of an antenna feeder-connecting terminal in accordance with the present invention.

FIG. 1 shows an antenna feeder-connecting terminal 10 disassembled from a terminal place 1. FIG. 2 shows a clad wire 21 and its core wire 22 of an antenna feeder 20, held in the terminal 10 of the present invention. The terminal 10 comprises a terminal body formed into a channel shape to have two side walls 11 and 12 and an upper wall 13. The side walls 11 and 12 extends downwardly and functions to a supporting member for the terminal to the terminal plate 1 by being inserted into slots 2 and 3 of said terminal plate 1, respectively. The side walls 11 and 12 have, at their middle portions thereof, members 11*a* and 12*a* for preventing the separation of the terminal 10 from the terminal plate 1, respectively. Each separation-preventing member 11*a* or 12*a* may be formed by punching each side wall 11 or 12. The member 11*a* and 12*a* engage with the lower surfaces of the edges of holes 2 and 3, respectively. A connecting member 11*b* which connects the terminal 10 to a terminal wire (not shown) of, for example, a television are formed on the lower end of the side wall 11 of the terminal.

In accordance with the present invention, the terminal 10 has, at the upper wall 13 thereof, resilient holding members 14 and 15 laterally spaced from each other with a certain distance. These holding members 14 and 15 are formed by cutting the portions of the upper wall 13 of the terminal body, at two positions laterally spaced from each other with a certain space, except for adjacent sides of said portions to be cut, and upwardly curving cut portions of the upper wall in opposite directions. The clad wire-holding member 14 includes an upwardly-extended connecting portion 14*a* connected to the upper wall 13 of the terminal body 10, a resilient holding portion 14*b* disposed at the middle portion of said holding member and spaced from the upper surface of the terminal body 10 to provide a wire-holding space between the lower surface of the holding portion 14*b* and the upper surface of the terminal body 10, and a guiding portion 14*c* disposed at the free end of said holding member and adapted to easily insert the clad wire 21 into said wire-holding space. Similarly, the core wire-holding member 15 includes a connecting portion 15*a*, a resilient holding portion 15*b* having a wire-holding space, and a guiding portion 15*c*.

Each wire-holding space of holding members 14 and 15 has a width slightly narrower than the diameter of the corresponding wire to be held therein. Accordingly, each wire can be firmly held in the wire-holding space of the holding member by a compressive force exerted by each holding portion of said holding member.

In order to connect an antenna feeder to the terminal having the above-mentioned construction in accordance with the present invention, the end of one clad wire 21 of said antenna feeder 20 is placed at a position between the upper surface 13 of the terminal body 10 and the guiding portion 14*c* disposed on the free end of the holding member 14. Then, the clad wire 21 is inwardly pushed into the wire-holding space of the holding member 14, against the compressive force of the resilient holding portion 14*b* of said holding member 14. Thereafter, the core wire 22 exposed from the end of the clad wire 21 is outwardly curved toward the holding member 15 disposed at a position opposite to the holding member 14. Then, the core wire is held in the wire-holding space of the holding member 15 in the same manner as above-mentioned. And also, the other clad wire of the antenna feeder 20 and its core wire are held the other terminal in the same manner as above-mentioned.

Thus, the feeder 20 is firmly and compressively held at the clad wire 21 by the resilient holding portion 14*b* of the holding member 14 and at the core wire 22 by the resilient holding portion 15*b* of the holding member 15 as shown in FIGS. 2 and 3. Therefore, the held condition of the feeder 20 in the terminal can be more assuredly and stably maintained, without an easy separation caused by an impact of the outside.

On the other hand, FIG. 4 shows a terminal in accordance with another embodiment of the present invention. In this case, the resilient holding portions 14*b* and 15*b* of the holding members 14 and 15 have one or more protrusions 14*d* and 15*d* downwardly extended from the lower surfaces of said resilient holding portions 14*b* and 15*b*, respectively. The protrusions 14*d* and 15*d* function to more firmly maintain the holding of wires in the holding members of the terminal.

As apparent from the above description, the antenna feeder-connecting terminal of the present invention makes the manufacture thereof and the feeder-holding work to be simple, by virtue of including two holding member integrally formed with a terminal body. And also, the holding and the separation of the feeder in and from the terminal can be easily carried out, without using a tool. In addition, the held condition of the feeder in the terminal is more assuredly and stably maintained, in that the terminal holds the core wire of the feeder, together with the clad wire of the feeder.

While the present invention has been described with reference to the preferred embodiments, it will be understood that the construction and the shape of the terminal of the present invention are not limited thereto, and various changes may be made.

What is claimed is:

1. An antenna feeder-connecting terminal for a television, comprising a terminal body formed into a channel shape to have an upper wall and two side walls each having a means for fixing the terminal to a terminal plate mounted on the television, one of said side wall provided, at the lower end thereof, with a means for connecting the terminal to a terminal wire of the television, said terminal being characterized in that said terminal body includes a pair of holding members adapted to hold the clad wire and the core wire of said antenna feeder therein and formed on the upper wall of said terminal body by partially cutting said upper wall and curving the cut portions of said upper wall in opposite directions, each holding member having a resilient holding portion spaced from the upper surface of said upper wall of terminal body to provide a wire-holding space with a width slightly narrower than the diameter of the corresponding wire and having a guiding portion adapted to guide the corresponding wire into said wire-holding space.

2. An antenna feeder-connecting terminal for a television in accordance with claim 1, wherein said resilient holding portion of each holding member has one or more protrusions downwardly extended from the lower surface of the holding member.

* * * * *